United States Patent [19]

Uemura et al.

[11] Patent Number: 5,061,413

[45] Date of Patent: Oct. 29, 1991

[54] PROCESS FOR PRODUCING PITCH-BASED CARBON FIBERS

[75] Inventors: Seiichi Uemura, Tokyo; Hiroaki Takashima, Kawasaki; Osamu Kato, Yokohama, all of Japan

[73] Assignee: Nippon Oil Company, Limited, Tokyo, Japan

[21] Appl. No.: 516,105

[22] Filed: Apr. 27, 1990

[30] Foreign Application Priority Data

Feb. 23, 1989 [JP] Japan ..... 1-41900

[51] Int. Cl.[5] ..... D01F 9/155

[52] U.S. Cl. ..... 264/29.2; 264/82; 264/83; 264/211.11; 208/22; 208/39; 208/41; 423/447.7; 423/447.8; 423/448

[58] Field of Search ..... 208/39, 41, 22; 264/29.2, 211.11, 82, 83; 423/447.1, 447.7, 447.8, 448

[56] References Cited

U.S. PATENT DOCUMENTS

| | | | |
|---|---|---|---|
| 4,005,183 | 1/1977 | Singer | 423/447.2 |
| 4,209,500 | 6/1980 | Chwastiak et al. | 423/447.6 |
| 4,469,667 | 9/1984 | Uemura et al. | 208/22 |
| 4,575,411 | 3/1986 | Uemura et al. | 208/22 |
| 4,620,919 | 11/1986 | Uemura et al. | 208/22 |
| 4,717,331 | 1/1988 | Maeda et al. | 425/467 |

FOREIGN PATENT DOCUMENTS

| | | |
|---|---|---|
| 49-19127 | 2/1974 | Japan . |
| 59-3567 | 1/1984 | Japan . |
| 60-4286 | 2/1985 | Japan . |

OTHER PUBLICATIONS

*Carbon* vol. 16 pp. 408–415 by Leonard S. Singer.

High Modulus Pitch-Based Carbon Fibers by H. F. Volk, presented at the Symposium on Carbon-Fiber-Reinforced Plastics, May 11–12, 1977.

*Primary Examiner*—Hubert C. Lorin

*Attorney, Agent, or Firm*—Scully, Scott, Murphy & Presser

[57] ABSTRACT

A pitch-based carbon fiber having a high strength is produced by (a) treating a heavy oil at a temperature of 370° to 480° C. and a pressure of 2 to 50 kg/cm$^2$; (b) separating and removing insoluble solids from the heat-treated oil so that the insoluble solids content is not higher than 50 ppm; (c) subjecting the oil to thin film distillation at a temperature of 250° to 450° C., a pressure of not higher than 100 mm Hg and a film thickness of not larger than 5 mm; (d) heat-treating the resulting pitch at a temperature of 340° to 450° C. while passing an inert gas at atmospheric or reduced pressure to obtain an optically anisotropic pitch having a softening point of 260° to 300° C., a quinoline insolubles content of not higher than 40 wt % and an optically anisotropic phase content of 60 to 100 vol %; (e) melt-spinning said optically anesotropic pitch in a melt-spinning apparatus having a nozzle with a vertically longer molded product disposed therein, at a temperature of 280° to 360° C. and a spinning viscosity of 300 to 3,000 poise; (f) rendering the resulting pitch fiber infusible and (g) calcining the infusibilized fiber in an inert gas atmosphere, initially at a temperature of 650° to 850° C. and subsequently conducting calcination at a temperature of 1,200° to 3,000° C.

14 Claims, No Drawings

PROCESS FOR PRODUCING PITCH-BASED CARBON FIBERS

BACKGROUND OF THE INVENTION

The present invention relates to a process for producing a pitch-based carbon fiber.

It is known that a carbon fiber having high strength and high elastic modulus can be produced by heat-treating pitch to form a mesophase, then melt-spinning the pitch and subjecting the resulting pitch fiber to infusiblization, carbonization and graphitization (see Japanese Patent Publication Nos. 4286/1985 and 3567/1984). By this known method there can be obtained a carbon fiber having a tensile strength of 100 to 200 kg/mm$_2$ and an elastic modulus of 20 to 70 ton/mm$_2$.

If a carbonized fiber obtained using mesophase pitch is calcined in a graphitization region of 2,500° to 3,000° C., a graphitized structure is developed and the elastic modulus increases with increase of the calcining temperature. That is, an interlayer spacing ($d_{002}$) which can be said to be a measure of graphitization becomes narrower with increase of the calcining temperature, and it has been reported that when calcination is made in the graphitization region, the value of $d_{002}$ becomes 3.37 Å or smaller (see Japanese Patent Laid-Open No. 19127/1974). And the graphitized fiber has a three-dimensional order of a polycrystalline graphite characterized by the presence of (112) crosslattice line and (100), (101) lines in an X-ray diffraction pattern thereof.

On the other hand, with development of the graphitized structure, there occurs shrinkage of the carbon layer surface, causing cracks in the fiber. The cracks cause deterioration in the mechanical strength of the fiber. The carbonized fiber produced from mesophase pitch is formed by a giant domain (a carbon layer having a hexagonal network structure of carbon) extending straight in the fiber axis direction, so when graphitized, it is easily cracked.

Therefore, although a carbon fiber of high elastic modulus is obtained from pitch, it has been difficult to obtain a carbon fiber having a higher strength (e.g. 250 kg/mm$^2$ or more).

SUMMARY OF THE INVENTION

It is the object of the present invention to provide a carbon fiber having such a high strength as has been unattainable in conventional pitch-based carbon fibers.

Having made extensive studies for achieving the above-mentioned object, the present inventors found out a process for producing a carbon fiber having a tensile strength of 300 kg/mm$^2$ or more, particularly 350 kg/mm$^2$ or more, further 400 kg/mm$^2$ or more.

More specifically, the present invention resides in a process for producing a pitch-based carbon fiber, which process comprises heat-treating a heavy oil at a temperature of 370° to 480° C. and a pressure of 2 to 50 kg/cm$^2$, the said heavy oil being obtained by catalytic cracking of a petroleum and having a boiling point not lower than 200° C., separating and removing insoluble solids from the heat-treated oil to adjust the insoluble solids content to not higher than 50 ppm, then subjecting the oil to a thin film distillation at a temperature of 250° to 450° C., a pressure of not higher than 100 mmHg and a film thickness of not larger than 5 mm, heat-treating the resulting pitch at a temperature of 340° to 450° C. while passing an inert gas at atmospheric pressure or reduced pressure to obtain an optically anisotropic pitch having a softening point of 260° to 300° C., a quinoline insolubles content of not higher than 40 wt % and an optically anisotropic phase content of 60 to 100 vol %, then melt-spinning the optically anisotropic pitch in a melt-spinning apparatus having a nozzle with a vertically longer molded product disposed therein, at a spinning temperature of 280° to 360° C. and a spinning viscosity of 300 to 3,000 poise, rendering the resulting pitch fiber infusible at a temperature of 150° to 380° C. in an oxidizing gas atmosphere containing 0.1 to 30 vol % of $NO_2$, calcining the resulting infusiblized fiber at a temperature of 650° to 850° C. in an inert gas atmosphere, and subsequently conducting calcination at a temperature of 1,200° to 3,000° C. in an inert gas atmosphere.

DETAILED DESCRIPTION OF THE INVENTION

The process of the present invention will be described in detail hereinunder.

As the starting material there is used a heavy 5 oil having a boiling point of not lower than 200° C., preferably not lower than 300° C., obtained by fluid catalytic cracking of a petroleum such as vacuum gas oil.

First, the said heavy oil is subjected to a first-stage heat treatment at a temperature of 370° to 480° C., preferably 390° to 450° C., a pressure of 2 to 50 kg/cm$^2$, preferably 5 to 30 kg/cm$^2$, for 30 minutes to 10 hours, preferably 1 to 5 hours.

Next, insoluble solids, e.g. residual catalyst, are separated and removed from the heat-treated oil to adjust the insoluble solids content to not higher than 50 ppm, preferably not higher than 30 ppm. As the solids separating and removing method, a centrifugal separation method is particularly preferred. But there may be used another means, e.g. filtration, if only the insoluble solids content meets the aforesaid condition.

The oil from which insoluble solids were removed after the first-stage heat treatment is then subjected to a thin-film vacuum distillation at a temperature of 250° to 450° C., preferably 300° to 400° C., a pressure of not higher than 100 mmHg, preferably 1 to 50 mmHg, and a film thickness of not larger than 5 mm, preferably 0.1 to 5 mm to obtain pitch.

The pitch thus obtained is subjected to a second-stage heat treatment at a temperature of 340° to 450° C., preferably 360° to 410° C., for 1 to 50 hours, preferably 3 to 30 hours, while passing an inert gas such as nitrogen or steam at atmospheric pressure or reduced pressure, to obtain an optically anisotropic pitch containing 60–100 vol %, preferably 80–100 vol %, more preferably 90–100 vol %, of an optically anisotropic phase. This optically anisotropic pitch has a softening point of 260° to 300° C. and a quinoline insolubles content of not higher than 40 wt %, preferably 20 to 40 wt %.

The optically anisotropic pitch is melt-spun usually at a temperature higher by 30°–80° C. than its softening point. The melt spinning is performed using a melt spinning apparatus having a nozzle with a vertically longer molded product disposed therein which forms a space between it and the inner wall of the nozzle, the said space serving as a melt flowing path. The said vertically longer molded product indicates a molded product having a height larger than the width thereof. Its shape, which is not specially limited, may be selected from among various shapes, including cylinder, semi-cylinder, cone, prism, pyramid, ellipse, plate, and suitable combinations thereof. The side face of the vertically longer molded product may have, or preferably has, a groove or a projection. As the groove, a drill- or screw-like groove is particularly preferred.

It is necessary that in any cross section of the nozzle with the vertically longer molded product disposed therein there should be formed a space serving as a melt flowing path between the inner wall of the nozzle and the said molded product. The area of that space must be not smaller than the sectional area of a capillary portion of the nozzle.

Such spinning apparatus is disclosed in U.S. Pat. No. 4,717,331 of the present inventors, so this patent is incorporated herein as a reference.

The spinning is performed at a temperature of 280° to 360° C., preferably 300° to 340° C. Under the spinning conditions, the viscosity of the pitch is 300 to 3,000 poise, preferably 500 to 2,000 poise, more preferably 700 to 1,500 poise.

The pitch fiber obtained by the melt spinning, preferably under the application of a sizing agent, is would up onto a bobbin or accumulated in a vessel such as a container.

The pitch fiber is then rendered infusible in a wound-up state on the bobbin or in an accumulated state in a vessel after delivery from the bobbin or as accumulated in the vessel in the case of having been accumulated from the beginning.

The infusiblization treatment is performed in an oxidizing gas atmosphere at a temperature of 150° to 380° C., preferably 180° to 350° C., usually for 5 minutes to 3 hours, preferably 10 minutes to 2 hours. As the oxidizing gas it is desirable to use air which contains 0.1–30 vol %, preferably 0.5–20 vol %, more preferably 1–10 vol %, of $NO_2$.

The fiber thus rendered infusible is then calcined (hereinafter referred to as "precarbonization") at 650° to 850° C., preferably 670° to 830° C., in an inert gas atmosphere such as nitrogen for example, usually for 1 minute to 2 hours.

The fiber thus precarbonized is then subjected to a carbonization treatment at 1,200° to 3,000° C. in an inert gas atmosphere by a conventional method.

Now there is obtained a carbon fiber of a high strength which has heretofore been unobtainable using pitch.

Such remarkable improvement in the mechanical strength is presumed attributable to the fact that the carbon fiber obtained by the process of the present invention has a unique structure different from the conventional structure. More specifically, the carbon fiber produced by the process of the present invention has a carbon layer of a hexagonal network structure of carbon which is corrugated and therefore even when calcined at a temperature of 2,500° to 3,000° C., the carbon layer surface scarcely shrinks and the interlayer spacing will never become narrower than 3.37Å. Therefore, the fiber will not be cracked. Further, since the domain is corrugated, even if the domain is partially cracked, the cracking will stop at the top of the corrugation closest to the crack, so that the high strength is maintained. On the other hand, the conventional domain is plate-like, so once there occurs cracking at one end thereof, it will be propagated to the other end, causing cracking throughout the whole, thus rapidly resulting in deterioration of the strength.

When the carbon fiber in the present invention is observed its section in the fiber axis direction by means of a scanning type electron microscope (SEM), it can be confirmed that the carbon layer surface is corrugated. The pitch of the corrugation is in the range of 300 to 3,000 Å, preferably 500 to 2,000 Å.

The carbon fiber produced by the process of the present invention has a crystallite Lc of 100 to 300 Å, preferably 150 to 200Å, and La of 50 to 200 Å, preferably 70 to 160 Å, as determined by X-ray diffraction. The interlayer spacing $d_{002}$ thereof is in the range of 3.38 to 3.43 Å, and even after calcined in the graphitization region of 2,500° to 3,000° C., the value of $d_{002}$ is 3.38 Å or more, not becoming 3.37 Å or less. This is an outstanding feature.

In an X-ray diffraction pattern thereof, moreover, (112) line is not present although (100) and (101) lines are present.

According to the process of the present invention there can be produced a pitch-based carbon fiber of high elastic modulus and high strength. Particularly in point of tensile strength the process of the present invention can afford a carbon fiber having a high strength of 400 kg/mm$^2$ or higher which has been unattainable from conventional pitches.

A working example of the present invention is given below to illustrate the invention concretely. Example 1

A heavy oil having a boiling point of not lower than 300° C. which had been byproduced in a fluid catalytic cracking of a vacuum gas oil at 500° C., 1 kg/cm$^2$.G in the presence of a zerolite catalyst was heat-treated at a temperature of 410° C., a pressure of 12 kg/cm$^2$.G, for 3 hours. Insoluble solids were separated by centrifugal separation from the heat-treated oil to adjust the insoluble solids content to not higher than 10 ppm.

Next, the heat-treated oil after separation and removal of the insoluble solids in the above manner was subjected to a thin film distillation at a temperature of 355° C., a pressure of 20 mmHg and a film thickness of 2 mm to afford a pitch (1) having a softening point of 96° C.

The pitch (1) was heat-treated at 380° C. for 20 hours in an inert gas atmosphere to obtain a pitch (2) containing 97% of an optically anisotropic phase. The pitch (2) had a softening point of 275° C. and a quinoline insolubles content of 35%.

The pitch (2) was subjected to melt spinning at a temperature of 320° C. and at a spinning viscosity of 1,000 poise to obtain pitch fiber. The pitch fiber was then rendered infusible at 240° C. for 1 hour in an air atmosphere containing 5 vol % of $NO_2$. The fiber thus rendered infusible was calcined at 700° C. for 1 hour in an inert gas atmosphere to obtain a precarbonized fiber. This precarbonized fiber was subjected to a graphitization treatment at 2,250° C. to obtain a carbon fiber according to the present invention.

The carbon fiber had a tensile strength of 430 kg/mm$^2$ and a tensile modulus of 65 ton/mm$^2$.

What is claimed is:

1. A process for producing a pitch-based carbon fiber, comprising the steps of:

heat-treating a heavy oil at a temperature of 370° to 480° C. and a pressure of 2 to 50 kg/cm$^2$, said heavy oil being obtained by catalytic cracking of a petroleum and having a boiling point not lower than 200° C.:

separating and removing insoluble solids from the heat-treated oil to adjust the insoluble solids content to not higher than 50 ppm;

subjecting the oil to a thin film distillation at a temperature of 250° to 450° C., a pressure of not higher than 100 mmHg and a film thickness of not larger than 5 mm;

heat-treating the resulting pitch at a temperature of 340° to 450° C. while passing an inert gas at atmospheric pressure or reduced pressure to obtain an optically anisotropic pitch having a softening point of 260° to 300° C., a quinoline insolubles content of not higher than 40 wt % and an optically anisotropic phase content of 60 to 100 vol %;

melt-spinning said optically anisotropic pitch in a melt spinning apparatus having a nozzle with a vertically longer molded product disposed therein, at a temperature of 280° to 360° C. and a spinning viscosity of 300 to 3,000 poise;

rendering the resulting pitch fiber infusible at a temperature of 150° to 380° C. in an oxidizing gas atmosphere containing 0.1 to 30 vol % of $NO_2$;

calcining the infusiblized fiber at a temperature of 650° to 850° C. in an inert gas atmosphere; and subsequently conducting calcination at a temperature of 1,200° to 3,000° C. in an inert gas atmosphere.

2. The process according to claim 1, wherein the heavy oil is treated at a temperature ranging from 390° to 450° C.

3. The process according to claim 1 wherein the heavy oil is heated at a pressure ranging from 5 to 30 $kg/cm^2$.

4. The process according to claim 1 wherein the insoluble solids are removed by centrifugal separation.

5. The process according to claim 1 wherein the insoluble solids are removed by filtration.

6. The process according to claim 1 wherein the thin film distillation is effected at a temperature ranging from 300°–400° C.

7. The process according to claim 1 wherein the thin film distillation is effected at a pressure ranging from 1–50 mm Hg.

8. The process according to claim 1 wherein the pitch is heat-treated at a temperature ranging from 360°–410° C.

9. The process according to claim 1 wherein the optically anisotropic pitch is melt spun at a temperature ranging from 300°–340° C.

10. The process according to claim 1 wherein the viscosity of the anisotropic pitch in the melt-spinning step ranges from 500–2000 poise.

11. The process according to claim 10 wherein the viscosity of the anisotropic pitch ranges from 700–1500 poise.

12. The process according to claim 1 wherein the pitch fiber is infusibilized at a temperature ranging from 180°–250° C.

13. The process according to claim 1 wherein the pitch fiber is infusibilized in the presence of an oxidizing gas atmosphere containing 0.5–20 volume percent of $NO_2$.

14. The process according to claim 13 wherein the pitch fiber is infusibilized in the presence of an oxidizing gas atmosphere containing 1–10 volume percent of $NO_2$.

* * * * *